US010512912B2

(12) United States Patent
Brettschneider et al.

(10) Patent No.: US 10,512,912 B2
(45) Date of Patent: Dec. 24, 2019

(54) MICROFLUIDIC SYSTEM AND METHOD FOR ANALYZING A SAMPLE SOLUTION AND METHOD FOR PRODUCING A MICROFLUIDIC SYSTEM FOR ANALYZING A SAMPLE SOLUTION

(71) Applicant: Robert Bosch GmbH, Stuttgart (DE)

(72) Inventors: Thomas Brettschneider, Leonberg (DE); Jochen Hoffmann, Renningen (DE)

(73) Assignee: Robert Bosch GmbH, Stuttgart (DE)

( * ) Notice: Subject to any disclaimer, the term of this patent is extended or adjusted under 35 U.S.C. 154(b) by 195 days.

(21) Appl. No.: 15/520,923

(22) PCT Filed: Sep. 11, 2015

(86) PCT No.: PCT/EP2015/070836
§ 371 (c)(1),
(2) Date: Apr. 21, 2017

(87) PCT Pub. No.: WO2016/062457
PCT Pub. Date: Apr. 28, 2016

(65) Prior Publication Data

US 2017/0333899 A1 Nov. 23, 2017

(30) Foreign Application Priority Data

Oct. 21, 2014 (DE) ..... 10 2014 221 309

(51) Int. Cl.
*B01L 99/00* (2010.01)
*B01L 3/00* (2006.01)

(52) U.S. Cl.
CPC ..... *B01L 3/502738* (2013.01); *B01L 2200/10* (2013.01); *B01L 2300/087* (2013.01); *B01L 2300/0864* (2013.01)

(58) Field of Classification Search
None
See application file for complete search history.

(56) References Cited

U.S. PATENT DOCUMENTS 8,168,139 B2 * 5/2012 Manger ..... B01L 3/50273 422/502
2004/0005247 A1 * 1/2004 Karp ..... B01L 3/50273 422/400

(Continued)

FOREIGN PATENT DOCUMENTS

CA 2 620 629 A1 3/2007
DE 10 2009 035 270 A1 7/2010

(Continued)

OTHER PUBLICATIONS

International Search Report corresponding to PCT Application No. PCT/EP2015/070836, dated Nov. 23, 2015 (German and English language document) (7 pages).

*Primary Examiner* — Paul S Hyun
(74) *Attorney, Agent, or Firm* — Maginot, Moore & Beck LLP

(57) ABSTRACT

A microfluidic system for analyzing a sample solution includes a division chamber for accommodating an input volume of the sample solution. The division chamber has a plurality of partial volume segments for accommodating a plurality of partial volumes of the sample solution, which partial volumes can be used for detection reactions. The microfluidic system also has a displacing device configured to divide the input volume into the plurality of partial volumes.

12 Claims, 6 Drawing Sheets

(56) References Cited

U.S. PATENT DOCUMENTS

| | | | | |
|---|---|---|---|---|
| 2004/0180377 | A1* | 9/2004 | Manger | B01L 3/50273 435/7.1 |
| 2004/0238052 | A1 | 12/2004 | Karp et al. | |
| 2007/0004032 | A1 | 1/2007 | Lee et al. | |
| 2007/0051412 | A1 | 3/2007 | Heath et al. | |
| 2010/0159582 | A1 | 6/2010 | Ismail et al. | |
| 2010/0252118 | A1* | 10/2010 | Fraden | B01L 3/502746 137/2 |

FOREIGN PATENT DOCUMENTS

| | | | |
|---|---|---|---|
| EP | 1 915 618 | A2 | 4/2008 |
| WO | 02/29106 | A2 | 4/2002 |
| WO | 2004/089810 | A2 | 10/2004 |
| WO | 2007/044091 | A2 | 4/2007 |

* cited by examiner

MICROFLUIDIC SYSTEM AND METHOD FOR ANALYZING A SAMPLE SOLUTION AND METHOD FOR PRODUCING A MICROFLUIDIC SYSTEM FOR ANALYZING A SAMPLE SOLUTION

This application is a 35 U.S.C. § 371 National Stage Application of PCT/EP2015/070836, filed on Sep. 11, 2015, which claims the benefit of priority to Serial No. DE 10 2014 221 309.6, filed on Oct. 21, 2014 in Germany, the disclosures of which are incorporated herein by reference in their entirety.

The present disclosure relates to a microfluidic system for analyzing a sample solution, a method for analyzing a sample solution, and a method for producing a microfluidic system for analyzing a sample solution.

BACKGROUND

Microfluidic diagnosis systems such as chip laboratories or labs-on-a-chip (LoC) allow complex fluid work processes to be carried out in a miniaturized and integrated manner, particularly for the detection of a wide variety of substances. DE 102009035270 A1 describes a one-way multiplex polymerase chain reaction chip and device.

SUMMARY

Against this backdrop, the approach presented here presents a microfluidic system for analyzing a sample solution, a method for analyzing a sample solution, and a method for producing a microfluidic system for analyzing a sample solution according to the main claims. Advantageous embodiments are given in the respective dependent claims and the following description.

In particular, according to embodiments of the present disclosure, a microfluidic system can be provided that has a central chamber for accommodating a sample solution as a division chamber. By means of a displacement device or installation of a flexible membrane that is deflectable or deformable at predetermined sites, it can become possible to advantageously manipulate liquids or liquid samples. If the chamber contains or is filled with a sample solution, the membrane can be moved to form individual partial volumes or reaction chambers and enclose partial amounts or partial volumes of an introduced sample volume. For the purpose of sample division, one can optionally modify surfaces of the chamber at specified sites, for example in order to achieve hydrophilic and/or hydrophobic properties. Additionally or alternatively, the chamber can be physically subdivided by means of columns or the like. According to embodiments of the present disclosure, suitable structures and processes can be provided for subdividing and distributing a sample solution into a plurality of partial volumes or reaction chambers in order to allows testing of the sample solution for various parameters by means of independent and self-contained reactions.

According to embodiments of the present disclosure, an integrated division principle or aliquoting principle for a microfluidic system can advantageously be provided that allows the system to be further miniaturized and increased in degree of parallelization with respect to sample analysis. In each reaction chamber produced, or in each partial volume, for example, a separate detection reaction can be carried out or the sample solution can be tested for various parameters. This allows various detection reactions to be carried out within a single method or across all methods. The latter feature is advantageous in that a sample solution can be analyzed by means of different methods. This allows savings in both time and cost. The physical divisibility of the individual reaction chambers or partial volumes allows cross-contaminations and cross reactions resulting therefrom to be eliminated or minimized. For example, this makes it possible to dispense with the use of a DNA microarray for detecting various DNA molecules. In particular, as detection reactions can be carried out in one homogeneous phase, reaction kinetics can be accelerated, which can have a beneficial effect on duration of analysis, time-to-result, and sensitivity.

A microfluidic system for analyzing a sample is presented, wherein the microfluidic system has the following features:

a division chamber for accommodating an input volume of the sample solution, wherein the division chamber has a plurality of partial volume segments for accommodating partial volumes of the sample solution that are usable for detection reactions; and a displacing device configured to divide the input volume into the plurality of partial volumes.

The microfluidic system can be an analytical system, in particular a microfluidic lab-on-a-chip system or chip laboratory system for medical diagnosis, microbiological diagnosis, or environmental analysis. The microfluidic system can comprise a segment for introducing the sample solution into the microfluidic system and can additionally or alternatively have an actuating unit for supplying to the division chamber the sample solution, and optionally, substances for preparing and analyzing the sample solution. The term sample solution can refer to a liquid to be analyzed, typically a liquid or liquified patient sample such as blood, urine, stool, sputum, CSF, lavage, a rinsed-out smear, a liquified tissue sample, or a sample of a non-human material. The input volume of the sample solution can correspond to a volume of the sample solution introduced into the division chamber. In the partial volume segments, the partial volumes of the sample solution can be aggregated or isolated by means of the displacing device. In other words, the displacing device can be configured to aggregate or isolate the partial volumes of the sample solution in the partial volume segments. In particular, the displacing device can be configured to aliquot the sample solution. Aliquoting can be understood to refer to subdividing large liquid volumes into small ones and enclosing them in individual reaction chambers or partial volume segments. In this case, the sample solution can be divided into partial volume segments, partial volumes, or reaction chambers of the same or different sizes. For example, the displacing device can also be configured to carry out so-called metering of the sample solution. The displacing device can further be configured to carry out physical separation of the partial volumes from one another. By means of the displacing device or the aliquoting structure, for example, sample solutions in a chip laboratory system or lab-on-a-chip system can be analyzed in parallel, e.g. by means of multiple detection reactions. Examples of such reactions are reactions from the field of nucleic acid analysis and dilution series experiments such as efficacy tests, immunoassays, clinical chemistry, etc.

According to an embodiment, the displacing device can be configured to divide the input volume into the plurality of partial volumes and a residual volume. In this case, the displacing device can be configured to displace a sample solution contained in the residual volume from the division chamber. Alternatively, the displacing device can be configured in this case to provide a sample solution contained in the residual volume such that it can be rinsed out from the division chamber. In this case, the residual volume of the sample solution can be arranged outside the volume segments of the division chamber. This configuration is advantageous in that air inclusions in the division chamber can be prevented or minimized and in that additionally or alternatively, it becomes possible to remove the residual volume from the division chamber in a simple manner.

In particular, the displacing device can have at least one deflectable, flexible membrane. This configuration is advantageous in that the sample solution can be reliably divided in a uncomplicated manner.

In this case, at least one membrane in the area of the partial volume segment is connected to a main surface of the division chamber such that it cannot be deviated on at least part of its surface. Here, it is possible for the at least one membrane to be deviated outside the partial volume segment with at least part of its area being in contact with an opposite main surface of the division chamber. In particular, the membrane can be connected to sealing layer of a layered structure of the microfluidic system by means of a circular or flat arrangement. The membrane can be capable of being brought into contact with the opposite main surface of the division chamber in a ring-shaped or donut-shaped configuration. This configuration is advantageous in that it allows partial volumes of the sample solution to be formed or isolated from one another in a particularly simple manner.

A plurality of passage openings for guiding a medium to deflect the at least one membrane can also be provided, wherein the passage openings can be configured to open into the division chamber. The medium may be e.g. compressed air, oil, or the like. Means for applying pressure to the medium may be arranged on a side of the passage openings facing away from the discharge openings of said passage openings. This configuration is advantageous in that in this manner, the membrane can be reliably deflected for a defined duration using an uncomplicated construction.

According to an embodiment, reagents for detection reactions can be arrangeable or arranged in at least a partial number of the partial volume segments of the division chamber. In other words, the division chamber can contain prearranged reagents in at least a partial number of the partial residence segments. Here, the reagents may be identical, similar, or different. This prearrangement of various reagents in different areas of the division chamber is advantageous in that an independent reaction with a partial volume of the sample solution can be carried out in each partial volume segment.

The division chamber can also comprise an inlet opening for introducing the sample solution and optionally at least one further substance in the division chamber and at least one outlet opening for releasing substances from the division chamber. Examples of the at least one further substance include reagents for detection reactions and rinsing solutions. This configuration is advantageous in that substances can be introduced into the division chamber and discharged therefrom in a simple manner.

The division chamber may also comprise hydrophilic partial segments, hydrophobic partial segments, and additionally or alternatively, columns for promoting division of the input volume into the partial volumes. In the partial volume segments, for example, the division chamber can at least partially have a hydrophilic surface, and additionally or alternatively, at least partially have a hydrophobic surface outside the partial volume segment. This configuration is advantageous in that the division of the sample solution into the partial volumes can be accelerated and/or simplified.

Moreover, a method for analyzing a sample solution is presented, wherein the method comprises the following steps:

provision of an embodiment of the above-mentioned microfluidic system;

introduction of an input volume of the sample solution into the division chamber; and activation of the displacing device to divide the input volume into the plurality of partial volumes.

The method can be advantageously carried out in connection with an embodiment of the above-mentioned microfluidic system in order to analyze the sample solution. In the activation step, the displacing device can be activated such that the partial volumes remain physically separate for a specifiable duration by means of the displacing device. After the activation step, the method can also include a step of intermediate rinsing of the division chamber in order to rinse out from the division chamber a residual volume of the sample solution located outside the partial volume segment.

According to an embodiment, the method can also include a step of carrying out detection reactions with the partial volumes of the sample solution in the partial volume segments by means of reagents arranged in at least a partial number of the partial volume segments of the division chamber. Moreover, the method can include a step of evaluating the results of the detection reactions. In this case, the evaluation step can be carried out during, and additionally or alternatively, after the step of carrying out detection reactions. The method can also include a step of arranging the reagents for the detection reactions in at least a partial number of the partial volume segments of the division chamber. This configuration is advantageous in that it allows a time- and space-saving possibility for analyzing the sample solution to be provided. If the evaluation step is conducted during the step of carrying out detection reactions, this allows real-time measurement to be carried out in which quantitative data can be collected.

In particular, it can be advantageous to use a nested polymerase chain reaction or nested PCR. By amplifying a lengthy DNA region, for example containing a plurality of target sequences, from the sample solution in a first PCR, which e.g. can be carried out in a chamber divided by the division chamber, one can obtain sufficient material for individual detection reactions in a second PCR, which for example can be carried out in the division chamber. This makes it possible to prevent sample material to be tested, which can often contain very few target molecules, from being distributed among a plurality of reaction chambers directly or without preamplification, with the possible result that the individual chambers contain too little genetic raw material for a detection reaction.

A method for producing a microfluidic system for analyzing a sample solution is presented, wherein the method comprises the following steps:

forming of a division chamber for accommodating an input volume of the sample solution, such that the division chamber comprises a plurality of partial volume segments for accommodating partial volumes of the sample solution that are usable for detection reactions; and arrangement of a displacing device that is configured to divide the input volume into the plurality of partial volumes relative to the division chamber.

An embodiment of the above-mentioned microfluidic system can be advantageously produced by carrying out the method. In this case, the microfluidic system can be produced from polymer substrates by carrying out the steps of the method, for example by milling, injection molding, hot stamping, laser structuring, etc.

BRIEF DESCRIPTION OF THE DRAWINGS

By way of example, the approach presented here is explained in further detail below with reference to the attached drawings. The drawings show the following.

DETAILED DESCRIPTION

In the following description of favorable embodiments of the present disclosure, the same or similar reference symbols are used for the elements shown in the various figures having a similar action, with a repeated description of these elements being dispensed with.

Figure 1:
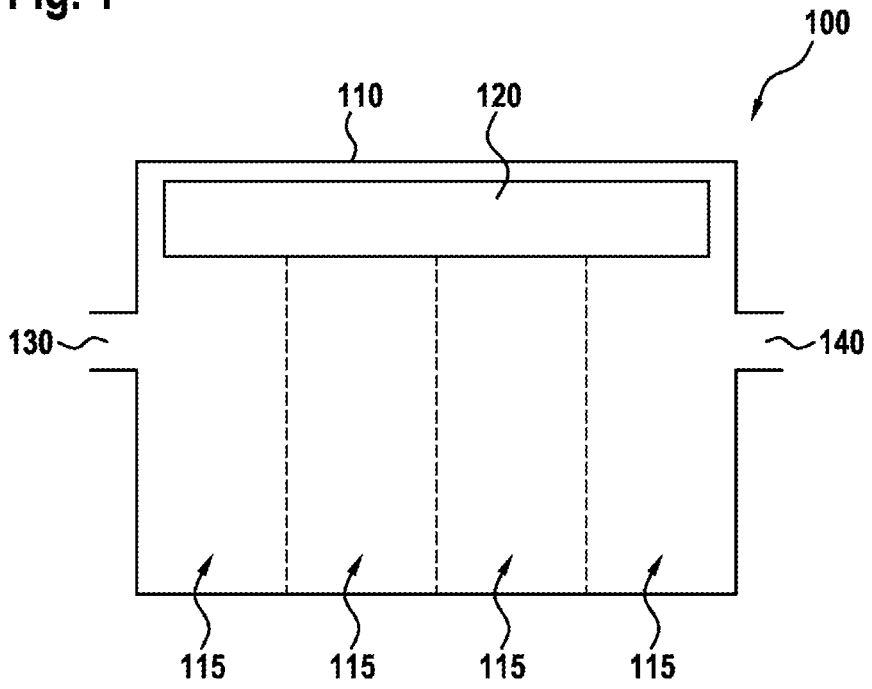
FIG. 1 is a schematic representation the microfluidic system according to an embodiment of the present invention disclosure.

FIG. 1 shows a schematic representation of the microfluidic system 100 according to an embodiment of the present disclosure. The microfluidic system 100 is configured to analyze a sample solution. For example, the microfluidic system 100 can be applied or used as an analytic system, in particular for microfluidic lab-on-a-chip systems or LOC systems for environmental analysis or medical diagnosis.

The microfluidic system 100 comprises a division chamber 110 for accommodating an input volume of the sample solution. In this case, the input volume of the sample solution corresponds at the maximum to an inner volume or a capacity of the division chamber 110.

The division chamber 110 comprises a plurality of partial volume segments 115. The division chamber 110 is subdivided into the plurality of partial volume segments 115. According to the embodiment of the present disclosure shown in FIG. 1, and for purposes of clarity, only four partial volume segments 115 of the division chamber 110 are shown as an example, wherein a microfluidic system according to another embodiment can comprise a different number of partial volume segments 115. In this case, the partial volume segments 115 are explicitly included in FIG. 1 only for illustrative purposes, because according to the embodiment of the present disclosure shown in FIG. 1, the division chamber 110 is configured as a uniform or continuous chamber.

The plurality of partial volume segments 115 is configured to accommodate partial volumes of the sample solution. Here, each of the partial volume segments 115 is configured to accommodate a partial volume of the sample solution. The partial volumes of the sample solution can be used for detection reactions with the sample solution.

FIG. 1 further shows a displacing device 120 of the microfluidic system 100. The microfluidic system 100 therefore also comprises the displacing device 120. The displacing device 120 is configured to divide the input volume of the sample solution into the plurality of partial volumes of the sample solution. When divided, the partial volumes can be arranged in the area of the partial volume segments 115 by activation or operation of the displacing device 120.

In particular, the displacing device 120 is configured to divide the input volume into the plurality of partial volumes and a residual volume. Here, the displacing device 120 is configured in a first variant to provide a sample solution contained in the residual volume such that it can be rinsed out from the division chamber 110, as shown for example in FIGS. 2A through 2E and 4A through 4D, or in a second variant to displace the sample solution from the division chamber 110, as shown for example in FIG. 3.

According to an embodiment, the division chamber 110 comprises an inlet opening 130 for introducing the sample solution and optionally at least one further substance into the division chamber 110 and one outlet opening 140 for releasing substances from the division chamber 110. The division chamber 110 can optionally comprise a plurality of outlet openings 140.

The following embodiments of microfluidic systems or aliquoting structures are described by way of example for a nested polymerase chain reaction (nested PCR), but are not limited to this molecular biological method.

Figure 2A:
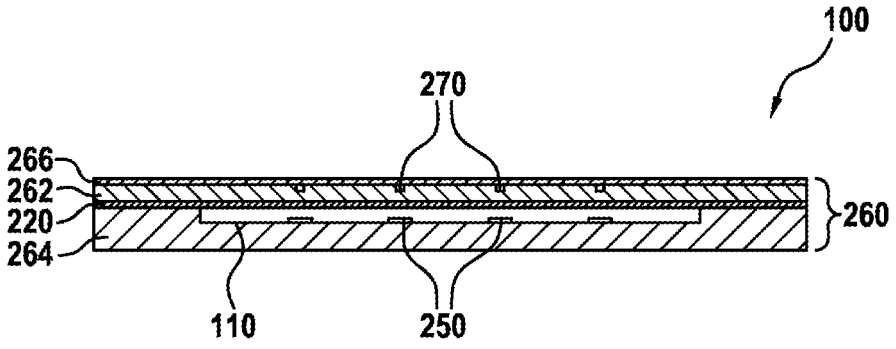
FIG. 2A shows a schematic sectional view of a microfluidic system according to an embodiment of the present disclosure.

FIG. 2A shows a schematic sectional view of a microfluidic system 100 according to an embodiment of the present disclosure. The microfluidic system 100 shown in FIG. 2A is e.g. the microfluidic system of FIG. 1, which is shown in FIG. 2A in another partial section in greater detail and/or in a specific variant embodiment. In this case, FIG. 2A shows the division chamber 110 and the segments of the microfluidic system 100 surrounding said microfluidic system 100. In other words, FIG. 2A shows a sectional view of the division chamber 110 of the microfluidic system 100 according to an embodiment of the present disclosure.

According to the embodiment of the present disclosure shown in FIG. 2A, the division chamber 110 has a rectangular cross-sectional profile. For example, the microfluidic system 100 comprises only a displaceable, flexible membrane 220 as a displacing device. In this case, the membrane 220 is arranged along a main side of the division chamber 110. In other words, the membrane 220 delimits the division chamber 110 on one of four sides of the cross-sectional profile of the division chamber 110 shown in FIG. 2A.

Reagents 250 are arranged in the division chamber 110. One of the reagents 250 each is arranged in one of the partial volume segments of the division chamber 110. FIG. 2A therefore shows, by way of example only, four packages or containers of reagents 250 arranged in the division chamber 110. Here, the reagents 250 are arranged on one of the main surfaces of the division chamber 110 opposite the membrane 220. Reagents 250 for division reactions are optionally arranged or arrangeable in at least a partial number of the partial volume segments of the division chamber 110.

FIG. 2A shows a layered structure 260 or layered composite of the microfluidic system 100 in which the division chamber 110, the membrane 220, and the reagents 250 are arranged. The layered structure 260 comprises a sealing layer 262, a base layer 264, and a covering layer 266. The sealing layer 262, the base layer 264, and the covering layer 266 are e.g. polymer substrates. An indentation 264 is formed in the base layer that corresponds to the division chamber 110 when it is open on one side. The membrane 220 extends beyond the indentation in base layer 264 or spans the indentation. In this manner, the division chamber 110 is delimited by the base layer 264 and the membrane 220. Here, the membrane 220 is arranged between the base layer 264 and the sealing layer 262. The covering layer 266 is arranged on one of the surfaces of the sealing layer 262 facing away from the membrane 220.

Passage openings or channels 270 are formed in the sealing layer 262. In the representation of FIG. 2A, only four channels 270 are shown by way of example. The channels 270 are configured to guide a medium for displacing the membrane 220. Although this is not shown in FIG. 2A for purposes of clarity, the channels 270 are configured to open into the division chamber 110. Here, an external pressure may be applied to the channels 270 in order to pressurize the medium so as to deviate the membrane 220.

Although not explicitly shown in FIG. 2A, the membrane 220 in the area of the partial volume segments of the division chamber 110 is connected to a surface of the sealing layer 262 such that it cannot be deviated on at least part of its surface, said surface representing a main surface of the division chamber 110. Moreover, the membrane 220 can be deviated outside the partial volume segment of the division chamber 110 with at least part of its surface in contact with a main surface of the division chamber 110 opposite the membrane 220 or the sealing layer 262.

Figure 2B:
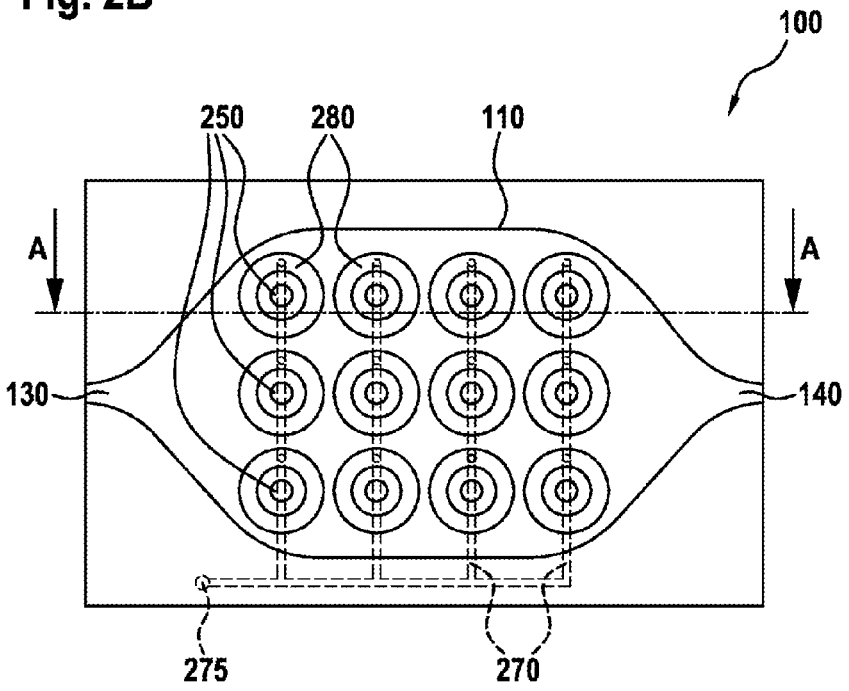
FIG. 2B shows a schematic top view of a portion of the microfluidic system shown in FIG. 2A.

FIG. 2B shows a schematic top view of the portion of the microfluidic system 100 shown in FIG. 2A. Here, a section line A-A in FIG. 2B illustrates a sectional plane of the sectional view of FIG. 2A. FIG. 2B shows the division chamber 110, the inlet opening 130, the outlet opening 140, the reagents 250, and the channels 270 of the microfluidic system 100.

In this case, solely by way of example, 12 packages of reagents 250 are arranged in the division chamber 110 of the microfluidic system 100, e.g. the division chamber 110 has 12 partial volume segments in this example. The channels 270 have outlets or discharge openings in each of the partial volume segments. The discharge openings are covered by the membrane. The channels 270 have a common connection opening 275 at the end facing away from the discharge openings. Pressure can be applied via the connection opening 275 to a medium that can be fed into the channels 270.

Moreover, deviation segments 280 of the membrane are shown in FIG. 2B. In the deviation segments 280, the membrane is displaceable, and outside the deviation segments 280, the membrane is bonded to the sealing layer of the layered structure and thus undisplaceable. Here, the deviation segments 280 are ring-shaped and enclose each of the partial volume segments in the division chamber 110.

Figure 2C:
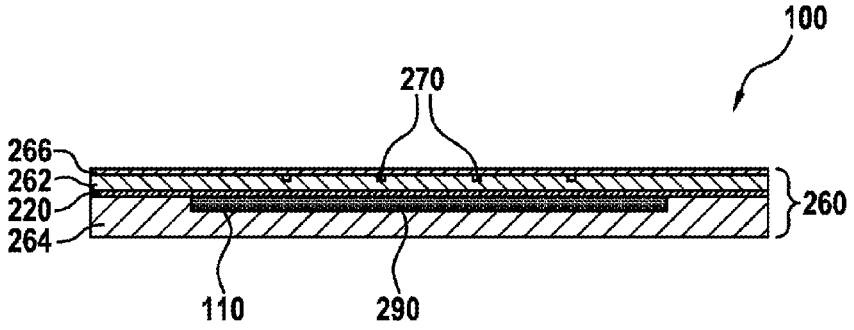
FIG. 2C shows a schematic sectional view of the microfluidic system of FIG. 2A or FIG. 2B with a division chamber in a filled state.

FIG. 2C shows a schematic sectional view of the microfluidic system 100 of FIG. 2A or FIG. 2B with the division chamber 110 in a filled state. Here, a sectional plane in FIG. 2C corresponds to the sectional plane of FIG. 2A, and the view of FIG. 2C corresponds to the view of FIG. 2A, except that an inner volume of the division chamber 110 is filled with the input volume 290 of the sample solution.

Figure 2D:
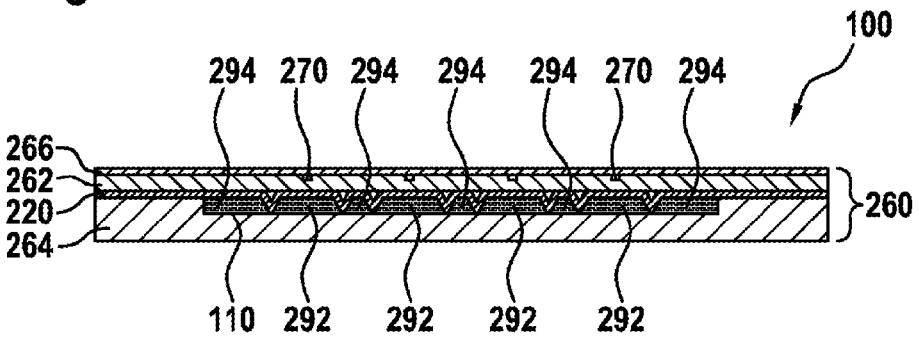
FIG. 2D shows a schematic sectional view of the microfluidic system of FIG. 2C in an activated state of a membrane.

FIG. 2D shows a schematic sectional view of the microfluidic system 100 of FIG. 2C in an activated state of the membrane 220. Here, the membrane 220 is deviated in the deviation segments 280 shown in FIG. 2B. The input volume of the sample solution shown in FIG. 2C is thus divided by means of the membrane 220 into partial volumes 292 within the partial volume segments and divided into a residual volume 294 outside the partial volume segment. In FIG. 2D, for purposes of clarity, four partial volumes 292 are therefore shown. The residual volume 294 is arranged between the partial volume segments and outside the partial volume segments.

Figure 2E:
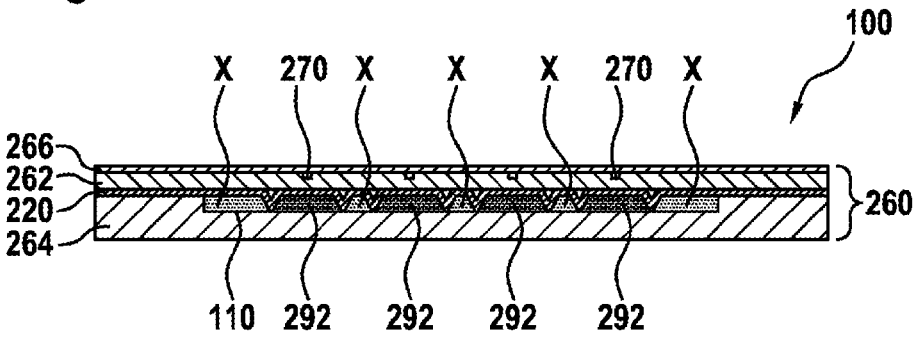
FIG. 2E shows a schematic sectional view of the microfluidic system of FIG. 2D in a partially rinsed state.

FIG. 2E shows a schematic sectional view of the microfluidic system 100 of FIG. 2D in a partially rinsed state. Here, the residual volume shown in FIG. 2D is displaced by a rinsing solution X, for example oil or the like. The partial volumes 292 in the partial volume segments are thus surrounded by the rinsing solution X, with the partial volumes 292 being sealed off with respect to the rinsing solution X by the deviated deviation segments of the membrane 220.

In other words, FIGS. 2A through 2E show an embodiment of the microfluidic system 100, wherein the flexible membrane 220 is installed on one of two main sides of the division chamber 110 or on the sealing layer 262. In the sealing layer 262, channels 270 are formed by means of which the deviation segments 280 of the flexible membrane 220 can be extended or deviated. Because of the circular sealing of the flexible membrane 220 to the sealing layer 262, wherein the seal for example corresponds to the contours of the deviation segments 280 of FIG. 2B, the membrane 220 in the deviated state can be brought into contact in a circular configuration with the side of the base layer 264 of the division chamber 110, as shown in particular in FIG. 2D. The prearranged reagents 250 are arranged within circles corresponding to the partial volume segments. In order to carry out an analysis, the sample solution or a PCR reaction mixture is rinsed into the division chamber 110. FIG. 2A shows a filled division chamber 110. When positive pressure is applied to the channels 270, this causes the membrane 220, or optionally a plurality of partial membranes, to deviate in the deviation segments 280. In this embodiment, the sample solution is completely enclosed or enclosed over its entire surface by a solid, i.e. the membrane 220 and the base layer 264. As shown in FIG. 2D, the donut-shaped deviation segments 280 formed enclose the partial volumes 292 or a partial amount of the sample solution. In this state, it is already possible to carry out a reaction, for example a thermally induced reaction in PCR, with the partial volumes 292. It is particularly advantageous, however, to first remove the liquid of the residual volume 294 enclosed in the intermediate spaces between the partial volume segments, for example by replacement with the rinsing solution X such as oil. This is advantageous in particular because fluorescent substances in the intermediate spaces are removed that could otherwise interfere with a reading process. This makes it possible to advantageously achieve simplified fluidics and reduce the risk of air inclusions in the division chamber 110 without requiring local (hydrophilic/hydrophobic) modification of surfaces in the division chamber 110.

Figure 3:
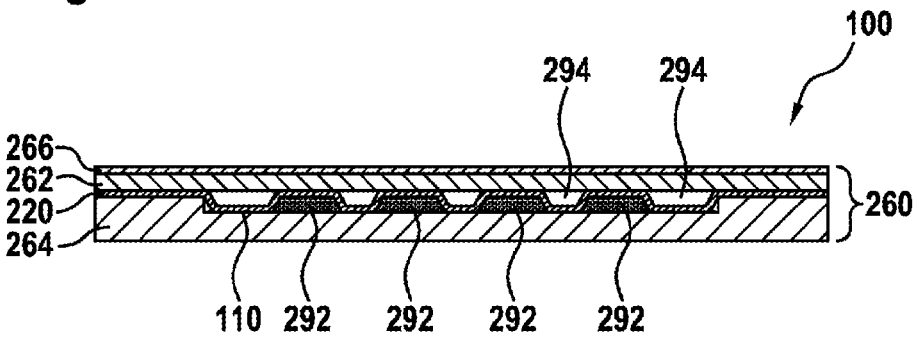
FIG. 3 shows a schematic sectional view of a microfluidic system according to another embodiment of the present disclosure.

FIG. 3 shows a schematic sectional view of the microfluidic system 100 according to an embodiment of the present disclosure. The microfluidic system 100 shown in FIG. 3 is e.g. the microfluidic system of FIG. 1, which is shown in FIG. 3 in another partial section in greater detail and/or in a specific variant embodiment. Here, the microfluidic system 100 shown in FIG. 3 corresponds to the microfluidic system of FIGS. 2A through 2E, except that the membrane 220 is sealed to the sealing layer 262 in a different manner and the channels in the sealing layer 262 have been omitted from the figure. More specifically, FIG. 3 is similar to FIG. 2E in this case.

In other words, FIG. 3 shows an embodiment for division or aliquoting of sample solutions. FIG. 3 shows the division chamber 110, the membrane 220, the layered structure 260, the sealing layer 262, the base layer 264, the covering layer 266, the partial volumes 292, and a residual volume 294 of the microfluidic system 100. In contrast to the embodiment of FIGS. 2A through 2E, the flexible membrane 220 is connected over its entire area to the sealing layer 262 in the areas of the partial volume segments. If pressure is applied to channels, which are also present in this microfluidic system 100 but are not shown for purposes of clarity, chambers form for dividing the sample solution into the partial volumes 292. In this case, by means of the membrane 220, the sample solution is enclosed by sealing over its entire surface or enclosed in the partial volume segments on the one hand, and excess sample solution is displaced from the residual volume 294 of the division chamber 110 on the other.

Figure 4A:
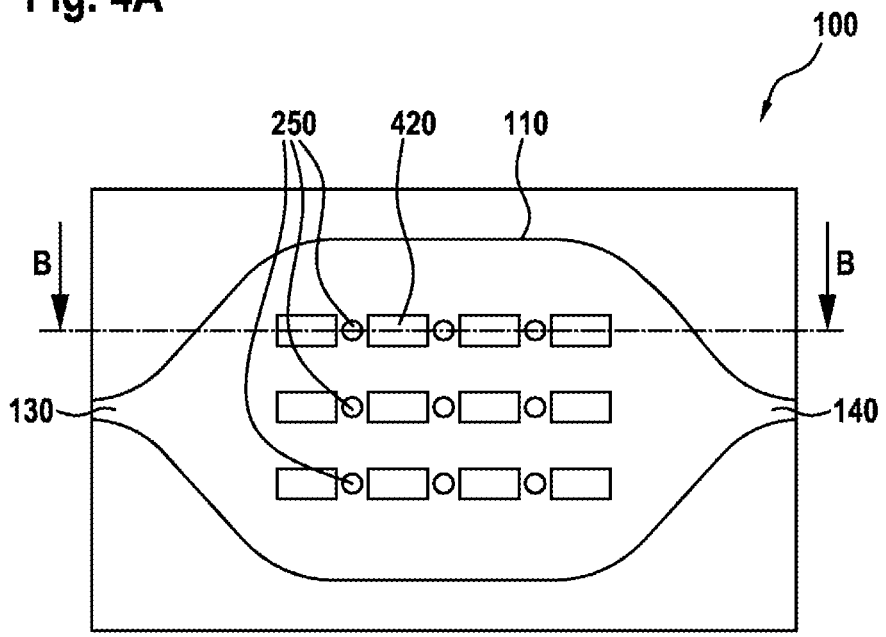
FIG. 4A shows a schematic top view of a microfluidic system according to yet another embodiment of the present invention.

FIG. 4A shows a schematic top view of the microfluidic system 100 according to an embodiment of the present disclosure. For example, the microfluidic system 100 shown in FIG. 4A is the microfluidic system of FIG. 1, which is shown in FIG. 4A in another partial section in greater detail and/or in a specific variant embodiment. The view of FIG. 4A is similar to that of FIG. 2B.

A division chamber 110, an inlet opening 130, an outlet opening 140, a plurality of e.g. 9 portions or containers of reagents 250, and a plurality of e.g. 12 columns 420 of the microfluidic system 100 are shown in FIG. 4A, wherein the columns 420 function as a displacing device. Here, the positions of the reagents 250 correspond to the positions of the partial volume segments of the division chamber 110. Each portion of the reagents 250 is arranged between two columns 420. Moreover, FIG. 4A shows a section line B-B, which illustrates a sectional plane through the microfluidic system 100 of FIG. 4B.

In other words, the microfluidic system 100 thus comprises a first microfluidic channel or an inlet opening 130 through which the division chamber 110 can be filled with a sample solution in order to displace air and moisture from the partial volume segments. Excess sample solution can be discharged via a second microfluidic channel or the outlet opening 140. The division chamber 110 comprises the plurality of columns 420 in a regular arrangement. When the division chamber 110 is filled, a liquid film is perforated at specified sites of the columns 420. The reagents 250 are prearranged in intermediate spaces or gaps between the columns 420.

Figure 4B:
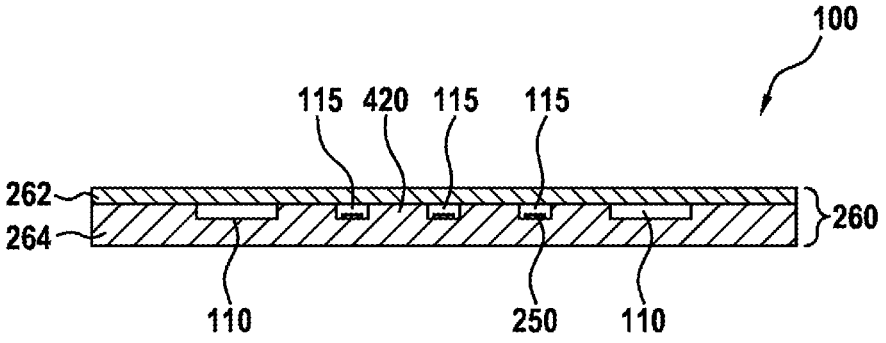
FIG. 4B shows a schematic sectional view of the microfluidic system of FIG. 4A in which a division chamber is subdivided by columns into partial volume segments.

FIG. 4B shows a schematic sectional view of the microfluidic system 100 of FIG. 4A. The division chamber 110 is subdivided by the columns 420 into the partial volume segments 115. The reagents 250 are arranged in the partial volume segments 115. FIG. 4B also shows a layered structure 260 of the microfluidic system 100. The layered structure 260 comprises a sealing layer 262 and a base layer 264. Here, the division chamber 110 is configured as an indentation segment of the base layer 264 covered with the sealing layer 262.

Figure 4C:
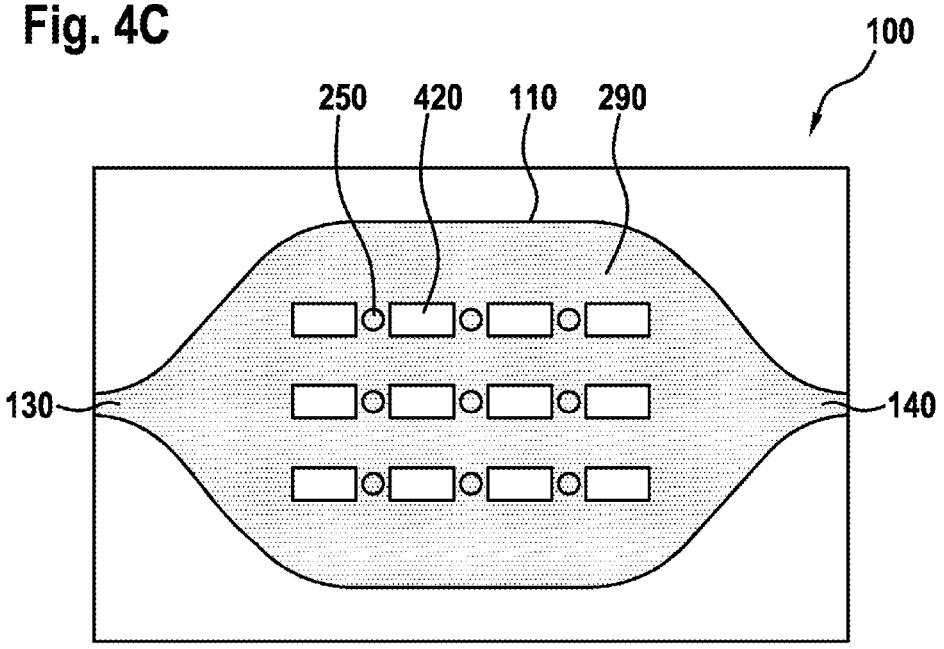
FIG. 4C shows the microfluidic system of FIG. 4A or FIG. 4B with the division chamber filled with an input volume of the sample solution.

FIG. 4C shows the microfluidic system 100 of FIG. 4A or FIG. 4B with the division chamber 110 filled. Here, the division chamber 110 is filled with an input volume 290 of the sample solution.

Figure 4D:
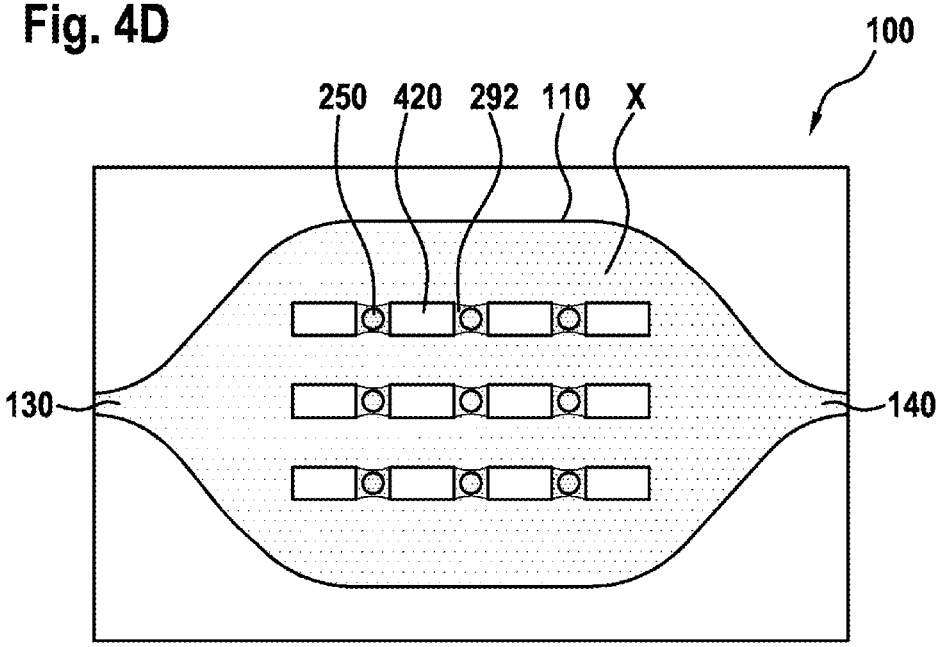
FIG. 4D shows the microfluidic system of FIG. 4A or FIG. 4B or FIG. 4C in a partially rinsed state with a portion of the input volume shown in FIG. 4C being displaced by a rinsing solution.

FIG. 4D shows the microfluidic system 100 of FIG. 4A or FIG. 4B or FIG. 4C in a partially rinsed state. Here, a portion of the input volume shown in FIG. 4C is displaced by a rinsing solution X such as oil or the like. As a result, the partial volumes 292 in the partial volume segments are surrounded by the columns 420 and the rinsing solution X.

In other words, FIG. 4D shows the division chamber 110 as a PCR chamber ready for a PCR reaction. When the division chamber 110, as shown in FIG. 4C, is filled with a sample solution or a PCR reaction mix, e.g. oil as the rinsing solution X is fed immediately afterward through the inlet opening 130 into the division chamber 110. This causes a portion of the sample solution not located between the columns 420 to be removed via the outlet opening 140 from the division chamber 110. Partial amounts of the sample solution can be fixed in partial volume segments by means of increased surface interaction. This can be supported by hydrophilic coating of the partial volume segments and hydrophobization of the areas of the division chamber 110 arranged surrounding or outside the partial volume segments. In other words, the partial volumes 292 of the sample solution are delimited on four sides by a solid and on two sides by the rinsing solution X, such as oil.

In the embodiment of the present disclosure shown in FIGS. 4A through 4D, the division chamber 110 comprises columns 420 for promoting division of the input volume 290 into the partial volumes 292 as a displacing device. According to a further embodiment, in addition or alternatively to columns, the division chamber 110 also comprises hydrophilic partial segments and/or hydrophobic partial segments as a displacing device.

Figure 5:
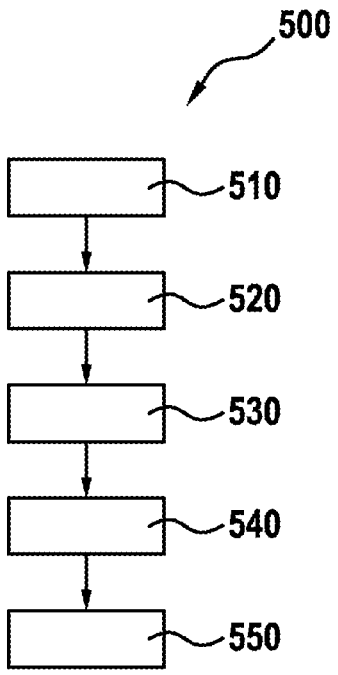
FIG. 5 is a flow diagram of an analysis method according to an embodiment of the present disclosure.

FIG. 5 shows a flow diagram of a method 500 according to an embodiment of the present disclosure. The method 500 is a method for analyzing a sample solution. The method 500 can be carried out in connection with or using a microfluidic system such as one of the microfluidic systems of FIGS. 1 through 4D.

The method 500 includes a step 510 of providing the microfluidic system. In this case, for example, the microfluidic system is one of the microfluidic systems of FIGS. 1 through 4D. In an introduction step 520 that can be carried out after the provision step 510, an input volume of the sample solution is introduced into the division chamber of the microfluidic system. In an activation step 530 following the introduction step 520, the displacing device is activated in order to divide the input volume into the plurality of partial volumes.

According to an embodiment, the method 500 further includes a step 540, carried out after the activation step 530, of conducting detection reactions with the partial volumes of the sample solution in the partial volume segments by means of reagents arranged in at least a partial number of the partial volume segments of the division chamber. Moreover, the method 500 also includes a step 550 of evaluating the results of the detection reactions. Here, the evaluation step 550 is carried out during the step 540 of carrying out detection reactions, and additionally or alternatively, after the step 540 of carrying out detection reactions.

Figure 6:
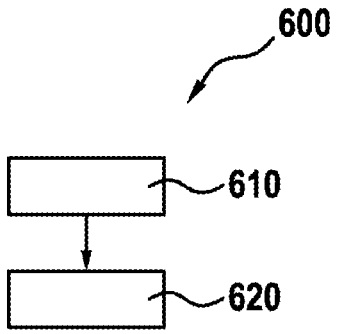
FIG. 6 is a flow diagram of a production method according to an embodiment of the present disclosure.

FIG. 6 shows a flow diagram of a method 600 according to an embodiment of the present disclosure. The method 600 is a method for producing a microfluidic system for analyzing a sample solution. A microfluidic system such as one of the microfluidic systems of FIGS. 1 through 4D can be produced by carrying out the method 600.

The method 600 includes a step 610 of forming a division chamber for accommodating an input volume of the sample solution. Here, the forming step 610 is carried out such that the division chamber comprises a plurality of partial volume segments for accommodating partial volumes of the sample solution that are usable for detection reactions. In other words, in the forming step 610, the division chamber is formed with a plurality of partial volume segments. Moreover, the method 600 includes a step 620 of arranging a displacing device that is configured to divide the input volume into the plurality of partial volumes relative to the division chamber.

In particular, the production method 600 can be carried out using polymer substrates for the microfluidic system. Structures in the polymer substrates can be produced for example by milling, injection molding, hot stamping, or laser structuring in the method 600. Examples of materials for such polymer substrates include thermoplastics such as PC, PP, PE, PMMA, COP, COC, or the like; examples of materials for a membrane or polymer membrane as a displacing device include elastomers, thermoplastic elastomers (TPU), TPS, thermoplastics, hot adhesive films, and sealing films for microtiter plates or the like; examples of materials for surface modification include sugars such as saccharose and xanthan, polymers such as alkanes, alkenes, and alkynes, i.e. paraffins and oils, or polyethylene glycol or detergents such as Tween, sodium dodecyl sulfate or the like. Examples of the dimensions of embodiments of the microfluidic system that can be produced by means of the method 600 are 0.5 to 5 mm for the thickness of a polymer substrate, 10 μm to 3 mm for the channel diameter of polymer substrates, 5 to 500 μm for the thickness of the polymer membrane, and 1 to 1,000 $mm^3$ for the volume of cavities or chambers in the polymer substrates.

One of the methods 500 or 600 in one of FIG. 5 or 6 can also optionally include a step of arranging reagents for the detection reactions in at least a partial number of the partial volume segments of the division chamber. Examples of these reagents include PCR primers and probes for the specific detection of DNA fragments or the like. The reagents can be prearranged such that they are taken up or rehydrated by the sample solution only after a specified time or in a time-controlled manner, or at a specified temperature or in a temperature-controlled manner. Examples of substances that can be used for prearrangement of the reagents include xanthan, trehalose and the like.

The embodiments described and shown in the figures are selected only by way of example. Various embodiments can be combined with one another either completely or with respect to individual features. An embodiment can also be supplemented with features of another embodiment. Moreover, the process steps presented here can be repeated and carried out in a sequence different from that described.

When an exemplary embodiment includes the connecting phrase "and/or" between a first feature and a second feature, this is to be read as meaning that said embodiment comprises both the first and the second feature according to one form of the embodiment and either the first feature alone or the second feature alone according to another form of the embodiment.

The invention claimed is:

1. A microfluidic system for analyzing a sample solution, comprising:

a division chamber configured to accommodate an input volume of the sample solution, the division chamber including a plurality of partial volume segments configured to accommodate a plurality of partial volumes of the input volume for detection reactions; and a displacing device configured to divide the input volume into the plurality of partial volumes and a residual volume, wherein at least a portion of the residual volume is one or more of rinseable and displaceable out of the division chamber while the divided partial volumes remain in the respective partial volume segments, wherein the displacing device comprises at least one displaceable flexible membrane, wherein the at least one membrane overlaps the plurality of partial volume segments and, in an area of the plurality of partial volume segments, is connected to a main surface of the division chamber such that the at least one membrane cannot be deviated on at least part of a surface of the at least one membrane, wherein a portion of the at least one membrane is configured to be deviated outside the plurality of partial volume segments with a partial area of the deviated portion of the at least one membrane positioned in contact with an opposite main surface of the division chamber, the opposite main surface spaced from and positioned in facing opposition to the main surface, and wherein the at least one membrane physically separates the plurality of partial volumes from the residual volume when the partial area of the deviated portion of the at least one membrane contacts the opposite main surface.

2. The microfluidic system as claimed in claim 1, wherein the displacing device is configured to (i) displace a residual solution contained in the residual volume from the division chamber or (ii) provide the residual solution such that the residual solution is rinseable out of the division chamber.

3. The microfluidic system as claimed in claim 1, further comprising a plurality of passage openings configured to guide a medium to deflect the at least one membrane, wherein the passage openings are configured to open into the division chamber.

4. The microfluidic system as claimed in claim 1, wherein reagents for detection reactions are prearranged in at least a partial number of the plurality of partial volume segments of the division chamber.

5. The microfluidic system as claimed in claim 1, wherein the division chamber comprises an inlet opening configured to introduce the sample solution into the division chamber and at least one outlet opening configured to release substances from the division chamber.

6. A microfluidic system for analyzing a sample solution, comprising:

a division chamber configured to accommodate an input volume of the sample solution, the division chamber including a plurality of partial volume segments configured to accommodate a plurality of partial volumes of the input volume for detection reactions; and a displacing device configured to divide the input volume into the plurality of partial volumes and a residual volume, wherein at least a portion of the residual volume is one or more of rinseable and displaceable out of the division chamber while the divided partial volumes remain in the respective partial volume segments, wherein the displacing device comprises at least one displaceable flexible membrane, wherein the at least one membrane overlaps the plurality of partial volume segments and, in an area of the plurality of partial volume segments, is connected to a main surface of the division chamber such that the at least one membrane cannot be deviated on at least part of a surface of the at least one membrane, wherein a portion of the at least one membrane is configured to be deviated outside the plurality of partial volume segments with a partial area of the deviated portion of the at least one membrane positioned in contact with an opposite main surface of the division chamber, the opposite main surface spaced from and positioned in facing opposition to the main surface, and wherein the at least one membrane and the opposite main surface completely encapsulate the plurality of partial volumes when the partial area of the deviated portion of the at least one membrane contacts the opposite main surface.

7. A microfluidic system for analyzing a sample solution, comprising:

a division chamber configured to accommodate an input volume of the sample solution, the division chamber including a plurality of partial volume segments configured to accommodate a plurality of partial volumes of the input volume for detection reactions; and a displacing device configured to divide the input volume into the plurality of partial volumes and a residual volume, wherein at least a portion of the residual volume is one or more of rinseable and displaceable out of the division chamber while the divided partial volumes remain in the respective partial volume segments, and wherein the displacing device includes a plurality of columns configured to perforate the input volume, each partial volume segment of the plurality of partial volume segments arranged in intermediate spaces between at least two of the columns.

8. The microfluidic system as claimed in claim 7, wherein the division chamber comprises hydrophilic partial segments configured to promote division of the input volume into the plurality of partial volumes.

9. The microfluidic system as claimed in claim 7, wherein the division chamber comprises hydrophobic partial segments configured to promote division of the input volume into the plurality of partial volumes.

10. The microfluidic system as claimed in claim 7, wherein the division chamber comprises hydrophilic partial segments Hand hydrophobic partial segments configured to promote division of the input volume into the plurality of partial volumes.

11. The microfluidic system as claimed in claim 7, wherein a portion of the input volume is configured to be displaced by a rinsing solution, and wherein the columns are configured to retain the partial volumes in the intermediate spaces when the input volume is displaced from the division chamber by the rinsing solution.

12. The microfluidic system as claimed in claim 7, wherein reagents for detection reactions are prearranged in at least a partial number of the plurality of partial volume segments of the division chamber.

* * * * *